US007914385B2

(12) United States Patent
Palumbo et al.

(10) Patent No.: US 7,914,385 B2
(45) Date of Patent: Mar. 29, 2011

(54) DASHER BOARDS

(75) Inventors: Matthew Palumbo, Maple Grove, MN (US); Bruce Irving, Walterfalls (CA)

(73) Assignee: Sport Systems Unlimited Corp., Waterloo, Ontario (CA)

( * ) Notice: Subject to any disclaimer, the term of this patent is extended or adjusted under 35 U.S.C. 154(b) by 620 days.

(21) Appl. No.: 11/946,156

(22) Filed: Nov. 28, 2007

(65) Prior Publication Data

US 2009/0137329 A1 May 28, 2009

(51) Int. Cl.
*A63C 19/10* (2006.01)
*A63C 19/00* (2006.01)

(52) U.S. Cl. ..... 472/92

(58) Field of Classification Search ..... 472/92–94; 256/24–26; 428/430, 431
See application file for complete search history.

(56) References Cited

U.S. PATENT DOCUMENTS

| | | | | |
|---|---|---|---|---|
| 3,636,725 | A | 1/1972 | MacCracken | |
| 3,883,120 | A | 5/1975 | Tippmann | |
| 3,986,342 | A | 10/1976 | MacCracken | |
| 4,136,856 | A * | 1/1979 | Murdock | 256/24 |
| 4,157,885 | A | 6/1979 | Tippmann | |
| 4,271,622 | A | 6/1981 | Tippmann et al. | |
| 4,372,617 | A | 2/1983 | Zamboni | |
| 4,659,247 | A | 4/1987 | Steiner | |
| 4,883,267 | A | 11/1989 | Burley | |
| 4,905,970 | A | 3/1990 | Holmsten et al. | |
| 4,927,134 | A | 5/1990 | Burley | |
| 5,706,625 | A | 1/1998 | Vallance et al. | |
| 5,709,099 | A | 1/1998 | Blades et al. | |
| 5,863,030 | A | 1/1999 | Kotler et al. | |
| 5,953,882 | A | 9/1999 | Vallance et al. | |
| 6,004,217 | A | 12/1999 | Johnston et al. | |
| 6,004,218 | A | 12/1999 | Keating et al. | |
| D430,316 | S | 8/2000 | Guertin | |
| 6,095,503 | A | 8/2000 | Burley et al. | |
| 6,106,401 | A | 8/2000 | McAlpine | |
| 6,155,022 | A | 12/2000 | DeCanio et al. | |
| 6,551,429 | B1 | 4/2003 | McAlpine | |
| 6,598,365 | B2 | 7/2003 | Abraham et al. | |
| 6,622,434 | B1 | 9/2003 | Garrett | |
| D487,317 | S | 3/2004 | Guertin | |
| 6,698,121 | B2 | 3/2004 | Wardle et al. | |
| 6,761,641 | B2 | 7/2004 | Martin et al. | |
| 6,783,461 | B2 | 8/2004 | Frazier et al. | |
| 6,817,952 | B2 | 11/2004 | Martin et al. | |
| 7,077,756 | B2 | 7/2006 | Martin et al. | |

FOREIGN PATENT DOCUMENTS

| | | |
|---|---|---|
| CA | 2170493 | 2/1996 |
| CA | 2311427 | 1/1999 |
| DE | 29917587 U1 | 1/2000 |
| EP | 0180688 A1 | 5/1986 |
| FR | 2436329 | 4/1980 |

* cited by examiner

*Primary Examiner* — Kien T Nguyen
(74) *Attorney, Agent, or Firm* — Gerald E. Helget; Nelson R. Capes; Briggs and Morgan, P.A.

(57) ABSTRACT

Dasher board assemblies and methods for making the same. An example dasher board assembly may include a dasher board frame. A facing panel may be coupled to the frame. An adhesive member may be disposed between the frame and the facing panel. The adhesive member may attach the facing panel to the frame.

10 Claims, 6 Drawing Sheets

DASHER BOARDS

FIELD OF THE INVENTION

The present invention relates generally to the field of dasher boards for use in bounded sports arenas such as hockey and soccer arenas. More specifically, the present invention pertains to dasher boards with a facing panel that is attached to a dasher board frame with an adhesive member or tape.

BACKGROUND

Dasher boards are used in bounded sports arenas to demarcate a general boundary line dividing a playing field from on-looking spectators and to absorb impact from players as they maneuver the outer periphery of the playing field. The dasher boards are typically designed to be secure and stable in order to withstand vibration or shock while also providing the spectators with a clear and unobstructed view of the game. In the design of ice hockey rinks, for example, such dasher boards are designed to withstand significant impacts caused by hockey players skating or being pushed into the boards throughout the course of a game while also allowing spectators to view the game without obstructions.

A typical dasher board for a hockey rink includes a lower frame, an anchoring system for attaching the lower frame to the rink surface, an upper shielding pane, and a support mechanism for connecting the upper shielding pane to the lower frame. The dasher boards can be fabricated as either a fixed, continuous frame forming the boundary, or in demountable sections typically eight feet in length that are assembled together in an end-to-end fashion to form the boundary. In some designs, an ice retainer or ice dam is sometimes used on the bottom of the lower frame to prevent ice from creeping away from the playing surface. Of the known dasher boards, each has certain advantages and disadvantages. There is an ongoing need to provide alternative dasher boards as well as alternative methods for manufacturing dasher boards.

BRIEF SUMMARY

The invention provides design, material, and manufacturing method alternatives for dasher boards and/or dasher board assemblies. An example dasher board assembly may include a dasher board frame. A facing panel may be coupled to the frame. An adhesive member may be disposed between the frame and the facing panel. The adhesive member may attach the facing panel to the frame.

Another example dasher board assembly may include a dasher board frame. A facing panel may be coupled to the frame. The facing panel may include a solid portion and a foam portion. A tape may be disposed between the frame and the facing panel. The tape may attach the facing panel to the frame.

An example method for manufacturing a dasher board assembly may include the steps of providing a dasher board frame, coextruding a solid polymer layer with a foam polymer layer to define a facing panel, and taping the facing panel to the dasher board frame.

The above summary of some embodiments is not intended to describe each disclosed embodiment or every implementation of the present invention. The Figures, and Detailed Description, which follow, more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
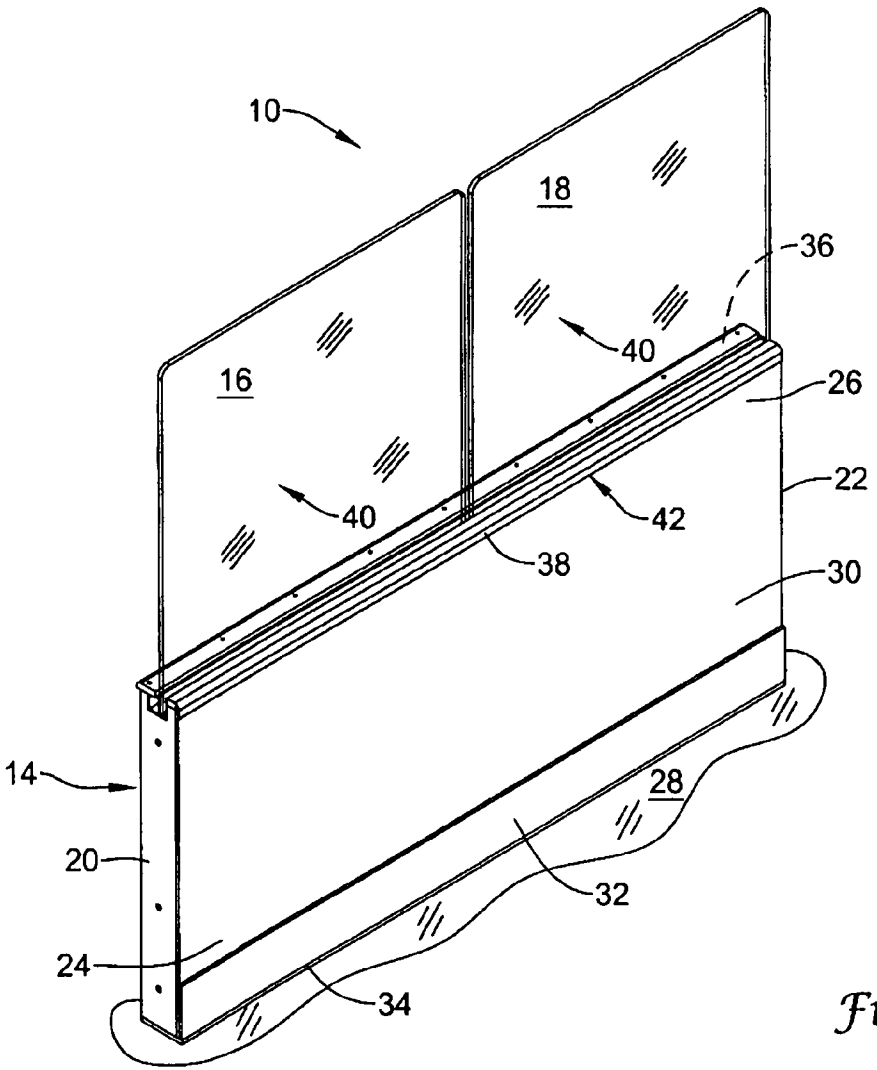
FIG. 1 is a perspective view of an example dasher board assembly.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

For the following defined terms, these definitions shall be applied, unless a different definition is given in the claims or elsewhere in this specification.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

The recitation of numerical ranges by endpoints includes all numbers within that range (e.g. 1 to 5 includes 1, 1.5, 2, 2.75, 3, 3.80, 4, and 5).

As used in this specification and the appended claims, the singular forms "a", "an", and "the" include plural referents unless the content clearly dictates otherwise. As used in this specification and the appended claims, the term "or" is generally employed in its sense including "and/or" unless the content clearly dictates otherwise.

The following detailed description should be read with reference to the drawings in which similar elements in different drawings are numbered the same. The drawings, which are not necessarily to scale, depict illustrative embodiments and are not intended to limit the scope of the invention.

FIG. 1 illustrates an example dasher board assembly 10. Assembly 10 may be one of a series of modular dasher board assemblies or segments that can be flexibly connected to each other in an end-to-end fashion to form a bounded area of a sports playing surface such as a hockey rink or soccer arena. In the illustrative view of FIG. 1, a single dasher board assembly 10 is depicted, which, when attached to other dasher board assemblies, forms a modularized dasher board system and/or the bounded area of a sports playing surface. It should be understood, however, that in other embodiments dasher board assembly 10 could be part of a fixed, continuous dasher board system, if desired.

Each dasher board assembly 10 can include a dasher board frame or frame assembly 14 adapted to vertically support a number of upper shielding panes 16/18. Frame 14 may include a first end section 20, a second end section 22, a lower section 24, and an upper section 26. Lower section 24 of frame 14 may be anchored to the underlying playing surface 28 (e.g., a concrete slab, the ground, etc.) of the arena or rink via an anchoring mechanism in order to secure dasher board assembly 10 in place.

The impact side (i.e., the side facing "inward" and/or toward the playing area) of frame 14 can be covered with a facing panel 30. Facing panel 30 may be supported on frame 14 by attaching panel 30 to one or more vertical posts (e.g., 1, 2, 3, 4, 5, etc.) and to one or more horizontal stringers (e.g., 1, 2, 3, 4, 5, etc.) disposed in frame 14. Some addition discussion regarding how panel 30 may be secured to frame 30 can be found below detail below. A kickboard 32 may be connected to the lower portion of panel 30 to further strengthen panel 30, for example, from hits with the players' skates. In some embodiments, an ice retainer or ice dam 34 can also be connected to lower section 24 of frame 14 to prevent ice from creeping away from playing surface 28.

The shielding panes 16/18 can be made from a variety of materials including tempered glass, acrylic, Plexiglass, or other suitable material. In embodiments where dasher board assemblies 10 utilize tempered glass, shielding panes 16/18 may be about ½" thick on the sides of the arena and about ⅝" thick on the ends and radius sections of the arena. Acrylic shielding panes 16/18, on the other hand, are typically about ½" thick at all locations. Shielding panes 16/18 may have a horizontal length of about 4 feet, with two such panes 16/18 typically spanning approximately an 8 foot length along dasher board assembly 10. The number and length of the shielding panes may vary, however, depending on the dimensions of each dasher board assembly 10.

Shielding panes 16/18 can be vertically supported at least in part using a sill 36 located on the upper periphery 38 of frame 14 adjacent to the non-impact or spectator side of dasher board assembly 12. Sill 36 may extend along all or a portion of the length of frame 14, and can be configured to abut the non-impact side of shielding panes 16/18 for support. Sill 36 may be formed from a relatively hard material such as high-density polyethylene (HDPE), which acts to support shielding panes 16/18 in place within frame 14 when deflected in the direction indicated generally by the arrows 40. Alternatively, shielding panes 16/18 may be disposed on top of frame 14 and supported vertical support bars (not shown).

As can be further seen in FIG. 1, each dasher board assembly 10 may include a top bumper 42 such as a SOFTCAP bumper 42 extending longitudinally along the upper periphery 38 of frame 14 between ends 20/22. In the illustrative embodiment depicted, bumper 42 is located along the upper periphery 38 adjacent the impact side of frame 14 and shielding panes 16/18. During use, the structure and material composition of the bumper 42 may be configured to provide impact absorption when a player strikes dasher board assembly 10, or when the player jumps a section of dasher board assembly 10 not containing shielding panes. Some additional details regarding the form and configuration of the SOFTCAP bumper 42 can be found in U.S. patent application Ser. No. 11/422,754, filed on Jun. 7, 2006 and entitled SOFT CAPS FOR DASHER BOARD ASSEMBLIES, the entire disclosure of which is herein incorporated by reference.

Figure 2:
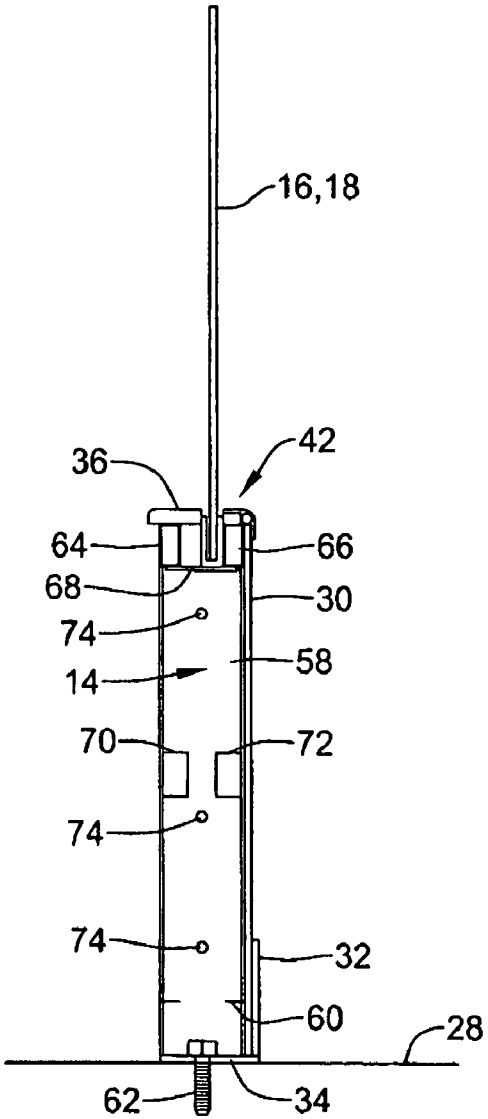
FIG. 2 is a partial cross-sectional side view of the dasher board assembly in FIG. 1.

As shown further in FIG. 2, frame 14 can further include a number of vertical posts 58 each connected or welded at a lower end thereof to a lower base plate or bottom channel 60 anchored into playing surface 28 via bolts 62. The upper ends of posts 58, in turn, are connected to several upper stringers 64/66 via a welding plate 68. A number of additional stringers 70/72 can be further connected to vertical posts 58 adjacent to panel 30 to provide additional structural support to frame 14, if desired. Several holes or openings 74 can be provided in vertical posts 58 to permit an adjacent dasher board assembly to be fastened together in an end-to-end manner so as to define a bounded enclosure such as a hockey rink or soccer arena.

Assembly of typical dasher board systems may include the installation of frame 14 and the attachment of facing panel 30 to frame 14. The attachment of facing panels in typical dasher boards is usually accomplished with screws. While this is an effective way of assembling dasher boards, installing the relatively large number of screws that may be required to secure the facing panel to the frame may be time consuming and labor intensive. This may increase the cost of the dasher board system. In addition, sometimes the screws can become partially dislodged or they may extend out, protrude, or otherwise stick out from the dasher boards. If the ends of these screws stick out into the playing area, they may have the potential to catch on players, players' uniforms, or other equipment, potentially causing harm to these objects. Furthermore, protruding screws may also catch on ice resurfacing machines (e.g., ZAMBONI® ice resurfacing machines), which could damage to these machines.

Figure 3:
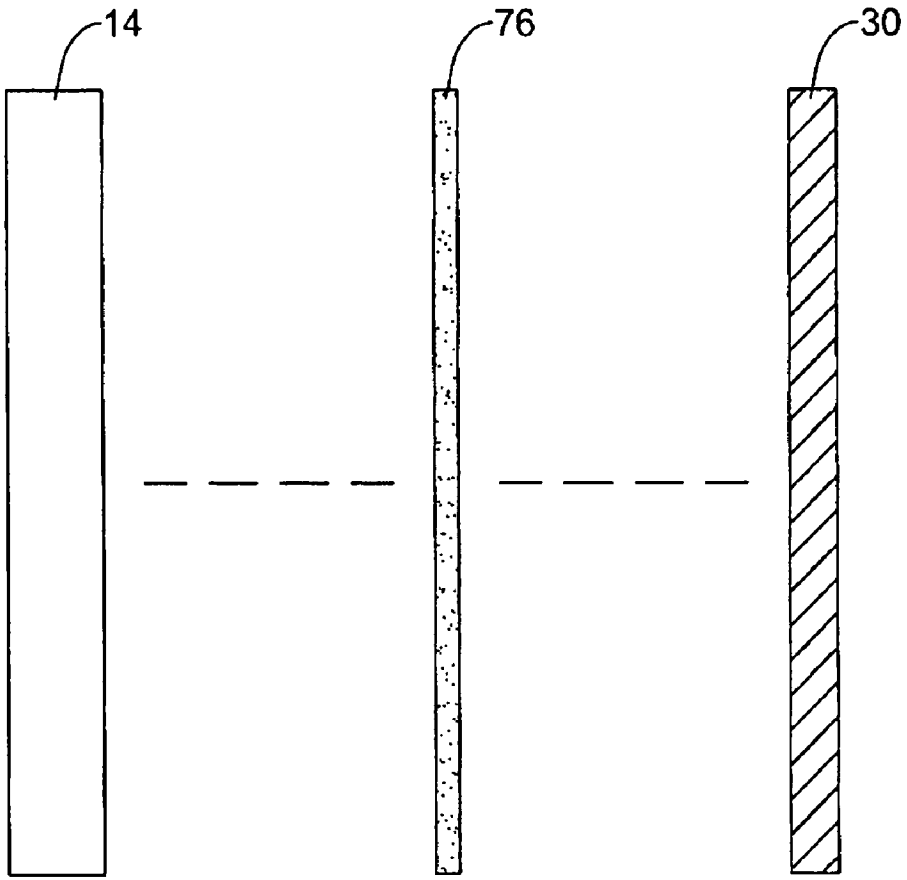
FIG. 3 is a partial cross-sectional exploded side view of an example dasher board assembly.

In at least some embodiments, facing panel 30 of assembly 10 may be secured to frame 14 through the use of an adhesive member 76 as depicted in FIG. 3. This may overcome some of the limitations of using screws to secure facing panel 30 to frame 14. In some embodiments, the only fastener that is used to secure facing panel 30 to frame 14 is adhesive member 76. In other embodiments, however, another fastener (e.g., screws, bolts, nails, etc.) may be used in addition to adhesive member 76.

The use of adhesive member 76 for the securing of facing panel 30 to frame 14, instead of screws, may be desirable for a number of reasons. For example, the use of adhesive member 76 may also provide assembly 10 with a "clean" or seamless appearance, which may be aesthetically pleasing. Furthermore, the use of adhesive member 76 may help to reduce the amount of time required to install assembly 10, thereby reducing the labor costs and, thus, the overall cost of assembly 10 (and/or the completed bounded area of a sports playing surface).

In some embodiments, securing facing panel 30 to frame 14 may include disposing adhesive member 76 along portions or all of one side of facing panel 30 and then pressing facing panel 30 onto frame 14. This may include providing a sheet of adhesive member 76 that is sufficiently sized to cover portions or all of facing panel 30 or it may include providing a plurality of discrete pieces or strips of adhesive member 76 and applying the pieces to the desired portions of facing panel 30. In other embodiments, adhesive member 76 may be disposed on the appropriate portions of frame 14 (e.g., posts 58, strings 64/66/70/72, etc.) and then facing panel 30 may be pressed onto frame 14.

Figure 4:
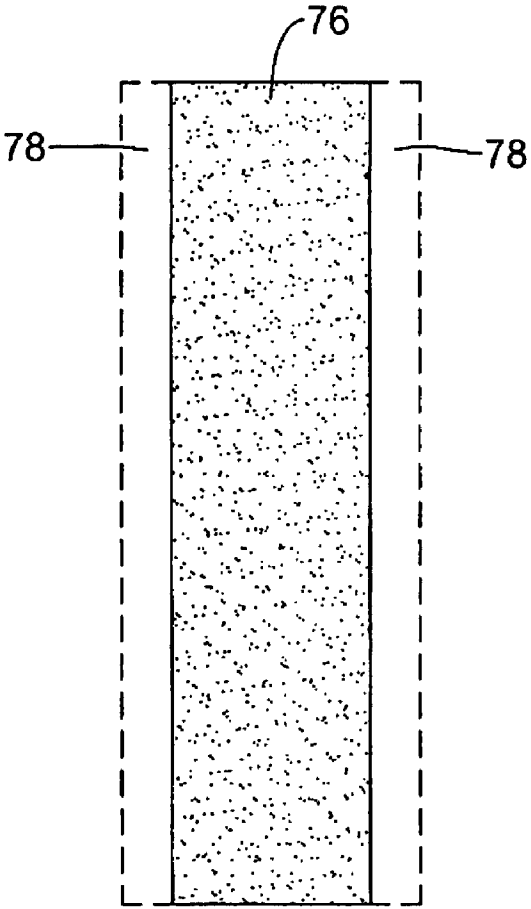
FIG. 4 is a side view of an example adhesive member.

The form of adhesive member 76 may vary. In some embodiments, adhesive member 76 is a layer of an adhesive such as an epoxy, glue, or the like. In other embodiments, adhesive member 76 may take the form of a tape, for example a double sided tape. In general, a tape is understood to be a substrate having an adhesive disposed on one (single sided) or both (double sided) sides. The tapes may be provided in a convenient use form such as in a roll, in strips, in pieces, etc. so that they can be efficiently used for their intended purpose. In addition, these tapes may or may not have a release liner(s) 78 (shown in FIG. 4) disposed over the adhesive that may further aid in the handling of the tape.

The substrates for suitable tapes may include, for example, an acrylic foam. Acrylic foams may be viscoelastic in nature, which may give the foam energy absorbing and stress relaxing properties. Suitable foams may be classified as conformable, very conformable, firm, or clear and any of these may be used for adhesive member 76.

The adhesives for suitable tapes may include a variety of different adhesives including multi-purpose acrylic adhesives, modified acrylic adhesives, general purpose acrylic adhesives, low temperature appliable acrylic adhesives, low surface energy adhesives, combinations thereof and the like, or any other suitable adhesive. In general, these adhesives may have performance characteristics that are suitable for securing facing panel 30 to frame 14. As such, adhesive members like adhesive member 76 may be sufficiently strong so that they can be used in place of screws, rivets, spot welds, liquid adhesives, other fasteners, and the like.

A number of suitable tapes are commercially available from 3M® (St. Paul, Minn.) that may be suitable for use as adhesive member 76. For example, adhesive member 76 may include any suitable 3M® VHB® tape such as 4941 family (e.g., 4926, 4936, 4919, 4936F, 4941, 4947, 4941F, 4956, 4979, 4956F, or 4991) tapes, 5952 family (e.g., 5925, 5952, or 5962) tapes, 4950 family (4920, 4930, 4929, 4930F, 4950, 4949, 4955, 4959, or 4959F) tapes, 4945 family (4945 or 4946) tapes, 4910 family (4905 or 4910) tapes, 4951 family (4951, 4943, or 4957) tapes, 4952 family (4932 or 4952) tapes, 4611 family (4646, 4611, or 4655) tapes, 4622 family (4618, 4622, or 4624) 3M® VHB® tapes, combinations thereof, and the like, or any other suitable tape.

In addition to variations in adhesive member 76, facing panel 30 may also vary in form. In some embodiments, facing panel 30 may be an extruded polymeric sheet. The sheets may be provided in a variety of different sizes. For example, the sheets may be about 4 feet by 8 feet. The size, of course, can vary depending the size of frame 14 and/or assembly 10. In addition, the particular polymer(s) utilized for facing panel 30 may also vary. For example, facing panel 30 may include a high-density polyethylene, a medium-density polyethylene, fiberglass, thermoplastic elastomer polyolefin (TPO), combinations thereof, and the like, or any other suitable material.

Figure 5:
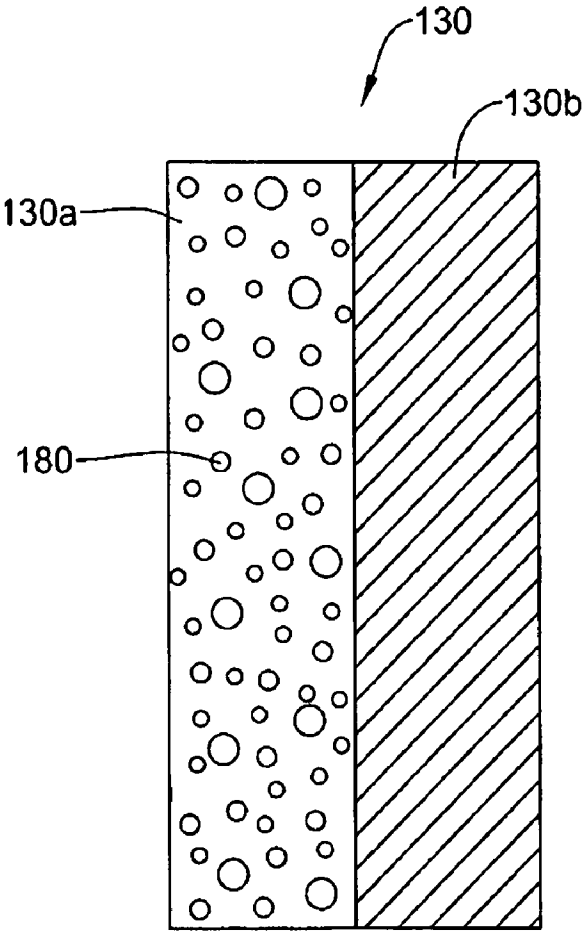
FIG. 5 is a cross-sectional side view of an example facing panel.

In some embodiments, facing panel 30 may be solid, single-layered sheet, for example, of extruded material. In other embodiments, however, facing panel 30 may have one or more layers. FIG. 5 illustrates another example facing panel 130, which may be utilized with any of the assemblies disclosed herein, that includes two layers or portions 130*a*/130*b*. In some embodiments, both of layers 130*a*/130*b* have the same form or configuration. In other embodiments, layers 130*a*/130*b* may differ. For example, layer 130*a* of facing panel 130 may be or include a foam having a plurality of air pockets or openings 180 whereas layer 130*b* may be generally solid. This configuration may be desirable, for example, because foam layer 130*a* may be sufficiently deformable so that facing panel 130 can provide a certain amount of "give" or provide impact absorption when a player strikes dasher board assembly 10, while still maintaining its integrity so that panel 130 can be securely attached to frame 14.

Just like panel 30, facing panel 130 may be secured to frame 14 with adhesive member 76. The use of facing panel 130 in concert with adhesive member 76, instead of screws, may be desirable for a number of reasons. For example, it can be appreciated that if screws were used to attach facing panel 130 to frame 14, the desirable impact absorption characteristics of facing panel 130 may be lost. This may be because if the screws were driven through facing panel 130 and into frame 14 in a manner so that facing panel 130 was secured onto frame 14, foam portion 130*a* may be sufficiently deformed or compressed so that it can no longer provide the desirable impact absorption. Thus, using screws to secure facing panel 130 to frame would limit if not overcome the desirable features of foam layer 130*a*.

Facing panel 130 may be manufactured in a variety of different manners. For example, layers 130*a*/130*b* may be coextruded to form panel 130. At the appropriate time, layer 130*a* can be injected with air so as to form openings 180 and create the foam-like appear in layer 130*a*. Alternatively, layers 130*a*/130*b* can be provided separately and joined together in the appropriate manner.

Figure 6:
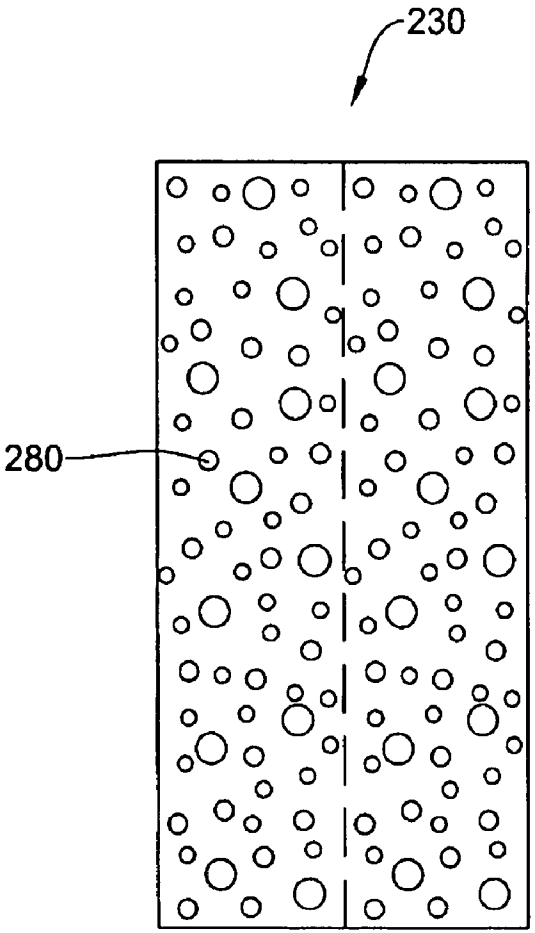
FIG. 6 is a cross-sectional side view of another example facing panel.

Alternative facing panels are also contemplated with different forms. For example, facing panel 230, which may be utilized with any of the dasher board assemblies disclosed herein, is illustrated in FIG. 6. Facing panel 230 may have a single foam layer having openings 280. Alternatively, facing panel 230 may have one or more foam layers that are joined together in the appropriate manner to form a single foam layer. The foam-like configuration of facing panel 230 may have some or all of the same desirable characteristics of foam layer 130*a*.

It should be understood that this disclosure is, in many respects, only illustrative. Changes may be made in details, particularly in matters of shape, size, and arrangement of steps without exceeding the scope of the invention. The invention's scope is, of course, defined in the language in which the appended claims are expressed.

What is claimed is:

1. A seamless dasher board assembly, comprising:

a dasher board frame of vertical posts and horizontal stringers;

a facing panel made of a thermoplastic elastomer polyolefin coupled to the frame; and a fastener consisting essentially of an adhesive double-sided tape disposed between the posts and the stringers of the frame and the facing panel that attaches the facing panel to the frame and is free of other fasteners.

2. The dasher board assembly of claim 1, wherein the adhesive double-sided tape includes an acrylic foam substrate.

3. The dasher boar assembly of claim 1, wherein the adhesive tape includes an acrylic adhesive.

4. The dasher board assembly of claim 1, wherein the facing panel includes a first portion and a second portion, and wherein the first portion is an acrylic foam.

5. The dasher board assembly of claim 4, wherein the second portion is an acrylic foam.

6. The dasher board assembly of claim 4, wherein the second portion is substantially solid.

7. The dasher board assembly of claim 6, wherein the first portion and the second portion are a coextruded sheet.

8. The dasher board assembly of claim 1, further comprising a shielding member disposed on a top surface of the frame.

9. A seamless dasher board assembly, comprising:

a dasher board frame of vertical posts and horizontal stringers;

a facing panel made of a thermoplastic elastomer polyolefin coupled to the frame, wherein the facing panel includes a solid portion and a foam portion; and an acrylic adhesive double-sided tape disposed between the posts and the stringers of the frame and the facing panel that attaches the facing panel to the frame and is free of other fasteners.

10. The dasher board assembly of claim 9, further comprising a shielding member disposed on a top surface of the frame.

* * * * *